US005918317A

United States Patent [19]

Bernhardt

[11] Patent Number: 5,918,317

[45] Date of Patent: Jul. 6, 1999

[54] GARMENT AND METHOD FOR PREVENTING CONTACT SORES WITH THE HUMAN BODY

[76] Inventor: Frederick S. Bernhardt, 705 Linton Ave., Croydon, Pa. 19021

[21] Appl. No.: 08/893,712

[22] Filed: Jul. 11, 1997

[51] Int. Cl.[6] ..... A41B 11/00

[52] U.S. Cl. ..... 2/239; 2/409; 2/69

[58] Field of Search ..... 2/239, 69, 243.1, 2/409, 272, 81, 85, 93, 115, 227, 228, 24; 36/42, 44

[56] References Cited

U.S. PATENT DOCUMENTS

| | | | |
|---|---|---|---|
| 3,451,232 | 6/1969 | Belzidsky . | |
| 4,261,061 | 4/1981 | McAlvage | 2/239 |
| 4,494,247 | 1/1985 | Kelly | 2/24 |
| 4,550,446 | 11/1985 | Herman | 2/239 |
| 4,635,626 | 1/1987 | Lerman . | |
| 4,816,626 | 3/1989 | Freund . | |
| 4,840,635 | 6/1989 | Smith . | |
| 4,843,844 | 7/1989 | Hursh et al. | 2/239 X |
| 5,050,241 | 9/1991 | Flowers . | |
| 5,154,682 | 10/1992 | Kellerman | 36/44 |
| 5,264,276 | 11/1993 | McGregor . | |
| 5,323,815 | 6/1994 | Barbeau et al. | 2/69 X |
| 5,399,418 | 3/1995 | Hartmanns . | |
| 5,480,455 | 1/1996 | Norvell . | |
| 5,575,012 | 11/1996 | Fox . | |
| 5,590,420 | 1/1997 | Gunn . | |
| 5,603,122 | 2/1997 | Kania . | |

*Primary Examiner*—Gloria M. Hale
*Attorney, Agent, or Firm*—LaMorte & Associates

[57] ABSTRACT

A device and method for reducing the creation of contact sores on the body caused by the body's contact with an external object. The present invention includes a garment having an internal surface and an external surface. The garment is preferably fabricated from a fabric material having at least one first thread made from a conventional garment material and a second thread made from a fluoropolymer material. The thread pattern is designed to cause the conventional garment material to be predominant on the interior surface of the garment while the fluoropolymer material is predominant on the exterior surface of the garment. The presence of the fluoropolymer material on the exterior surface of the garment causes the exterior of the garment to have a lower coefficient of friction than does the interior of the garment. As a result, the exterior of the garment moves across contacted objects with a minimum of chaffing while the skin remains padded by the static interior of the garment.

18 Claims, 4 Drawing Sheets

GARMENT AND METHOD FOR PREVENTING CONTACT SORES WITH THE HUMAN BODY

BACKGROUND OF THE INVENTION

1. Field of the Invention

The present invention relates to garments, materials for garments, and garment systems that are intended to reduce the occurrence of contact sores on the body, such as shoe induced foot ulcers and bed sores.

2. Prior Art Statement

Many people develop contact sores on their bodies. In healthy people, these sores are often caused by poor fitting shoes or another poor fitting garment. As the body moves in relation to the poor fitting garment, friction occurs against the skin which produces chaffing of the skin. Without correction, the chaffing can lead to blistering and finally an open sore.

The problem of contact sores need not be caused by poorly fitting garments. People afflicted with diabetes or circulatory maladies often have skin that can blister and develop sores from the relatively minor chaffing of properly fitting garments. Furthermore, invalids and the infirm who are confined to a wheelchair or a bed, often develop contact sores at the points where their body weight is supported by the chair or bed.

In an attempt to reduce the occurrence of contact sores, garments have been developed in the prior art that contain static padding and position that padding against the skin. The padding in such garments helps distribute the forces acting on the skin at localized contact points, thereby reducing chaffing. However, the use of static padding does not work in many applications. For instance, if excess padding is added to a sock, a person's shoe may no longer fit properly. As a result, new chaffing points may be created and new blisters formed. Furthermore, excess padding may cause a shoe to be too tight and blood circulation can be adversely effected, thereby causing other maladies.

Another method used in the prior art to reduce contact sores is to reduce the amount of friction in between the skin and the garment surrounding the skin. Such a prior art method is exemplified in U.S. Pat. No. 5,575,012 to Fox et al., entitled METHOD FOR TREATING LEGWEAR AND PRODUCT. In the Fox patent, a sock is disclosed where the interior of the sock is coated with a fluoropolymer. The presence of the fluoropolymer reduces friction in between the skin of the foot and the sock. By reducing friction along this interface, it is believed that the amount of chaffing can be reduced and blisters can be avoided. Such a method is also disclosed in U.S. Pat. No. 5,590,420 to Gunn, entitled LOW FRICTION APPAREL, wherein only specific areas of the interior of a sock contain a low friction material.

A problem associated with coating the interior of a sock with a fluoropolymer is that movement in between the foot and the sock is promoted. The sock therefore moves relative to the foot and does not add any static padding to the foot. Without the static padding of the sock, contact forces are not dispersed against the foot. Certain areas of the foot therefore receive localized forces as the foot moves within the confines of a shoe. Such repeated contact can cause the skin to blister and a sore to develop. Furthermore, if a foot already contains a blister or an open sore, that blister or sore is caused to move past the material of the sock. The movement of the blister or sore relative to the sock can open the wound or otherwise aggravate the wound. As a result, although a sock with a slick interior may prevent the formation of some new contact sores, such socks prevent the proper healing of any sores that may develop or that already exist.

A need therefore exists in the prior art for a garment structure that reduces the formation of contact sores, distributes contact forces acting on the foot and does not aggravate or inhibit the healing of existing contact sores. This need is met by the present invention as described and claimed below.

SUMMARY OF THE INVENTION

The present invention is a device and method for reducing the creation of contact sores on the body caused by the body's contact with an external object. The present invention includes a garment having an internal surface and an external surface. The garment is preferably fabricated from a knitted or woven material having at least one first thread made from a conventional garment material and a second thread made from a fluoropolymer material. The knit pattern is designed to cause the conventional garment material to be predominant on the interior surface of the garment while the fluoropolymer material is predominant on the exterior surface of the garment. The presence of the fluoropolymer material on the exterior surface of the garment causes the exterior of the garment to have a lower coefficient of friction than does the interior of the garment. As a result, the exterior of the garment moves across contacted objects with a minimum of chaffing while the skin remains padded by the static interior of the garment. An optional cover can also be placed over the object being contacted. The cover has an exterior that has a low coefficient of friction. As a result, the interface between the garment and the cover has a low coefficient of friction that reduces localized contact pressures that may cause damage to the underlying skin.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention system can be used in conjunction with any garment worn over the skin, the present invention system is especially suitable for use in the manufacture of socks, stockings and shoe inserts. As a result, the first exemplary embodiment of the present invention system will show the present invention system configured as a sock and shoe insert in order to set forth the best mode contemplated for the invention.

Figure 1:
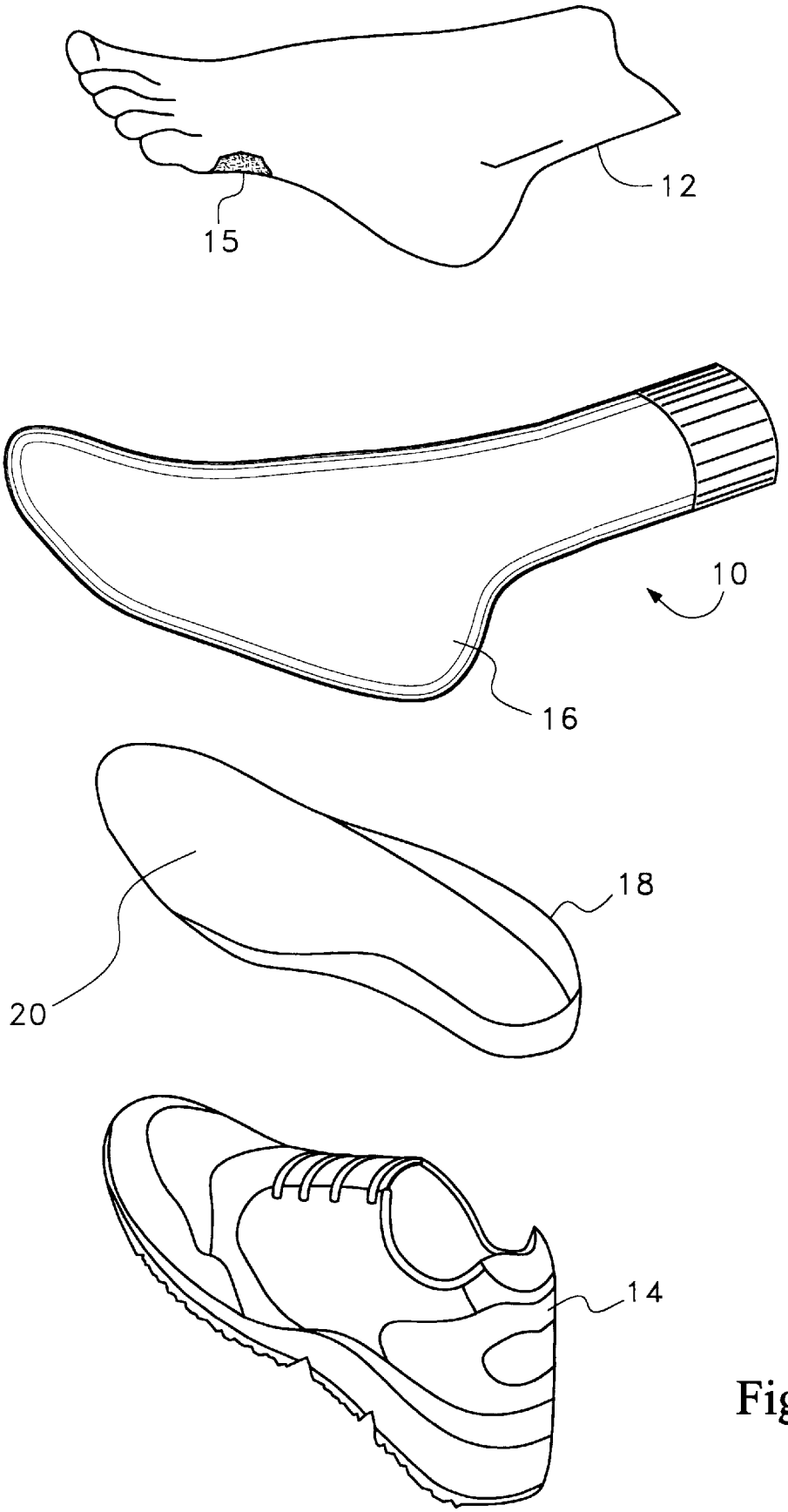
FIG. 1 is a perspective view of a sock and optional shoe insert made in accordance with the present invention. The sock and shoe insert are shown in conjunction with a foot and shoe to illustrate the intended use for the exemplary embodiment.

Referring to FIG. 1, an exemplary embodiment of the present invention system 10 is shown in conjunction with a foot 12 and a shoe 14. The present invention system 10 is embodied as a sock 16 that is worn around the foot 12 and an optional shoe insert 18 that is placed within the interior of the shoe 14. As will be explained, the structure of the sock 16 and shoe insert 18 work in unison to protect the foot 12 from contact sores and to promote healing of any contact sores that may already be present on the foot 12.

The sock 16 is preferably of a knit manufacture and contains conventional sock thread, such as cotton, acrylic, wool, polyester or the like. The knit of the sock 16 also includes a fluoropolymer thread such as polytetrafluoroethylene, commonly known as Teflon®. The sock 16 is knitted in a manner so that the conventional sock threads are the primary material that contacts the skin of the foot 12. As will later be described in more detail, the conventional sock threads provide cushioning the areas of the foot 12 covered by the sock 16. The fluoropolymer thread is configured in the knit pattern so that the fluoropolymer thread is the predominant thread on the exterior of the sock's structure. As a result, the exterior of the sock 16 embodies the low coefficient of friction associated with the fluoropolymer thread.

The use of a fluoropolymer thread in a knit pattern is preferred because of the lower cost, lower degree of labor and overall quality of the material produced. However, other methods to create a sock with a fluoropolymer on its exterior exist. In alternate embodiments, it will be understood that a conventional sock can have its exterior coated with a fluoropolymer material by a spraying or dipping procedure, whereby a sock structure is created that has a conventional interior surface and a smooth exterior surface with a low coefficient of friction. Such alternate methods of production can be used in practicing the present invention.

In FIG. 1, an optional shoe insert 18 is also shown. The shoe insert 18 has a top surface 20 that is coated with a fluoropolymer material or a similar material that has a relatively low coefficient of friction. The shoe insert 18 is sized to fit within the shoe 14. The shoe insert 18 is placed within a persons's shoes, wherein the shoe insert 18 covers the interior sole of the shoe 14. A sock 16 is then placed on each of the feet. As a person places a sock 16 onto their foot 12, the material of the sock 16 cushions the foot 12 including any contact sore 15 that may be present on that foot 12. Since the interior of the sock 16 is made from conventional sock material, the degree of friction in between the sock 16 and the foot 12 is approximately the same as with the use of a conventional prior art socks. As the foot 12 and sock 16 are placed within the shoe 14, the smooth exterior of the sock 16 abuts against the smooth top surface 20 of the shoe insert 18. The coefficient of friction in between the exterior of the sock 16 and the top surface 20 of the shoe insert 18 is therefore less than the coefficient of friction in between the foot 12 and the sock 16 or the coefficient of friction in between the shoe insert 18 and the shoe 14. The sock 16 is therefore more likely to move relative to the shoe insert top surface 20 in response to any force applied by the foot 12.

Figure 2:
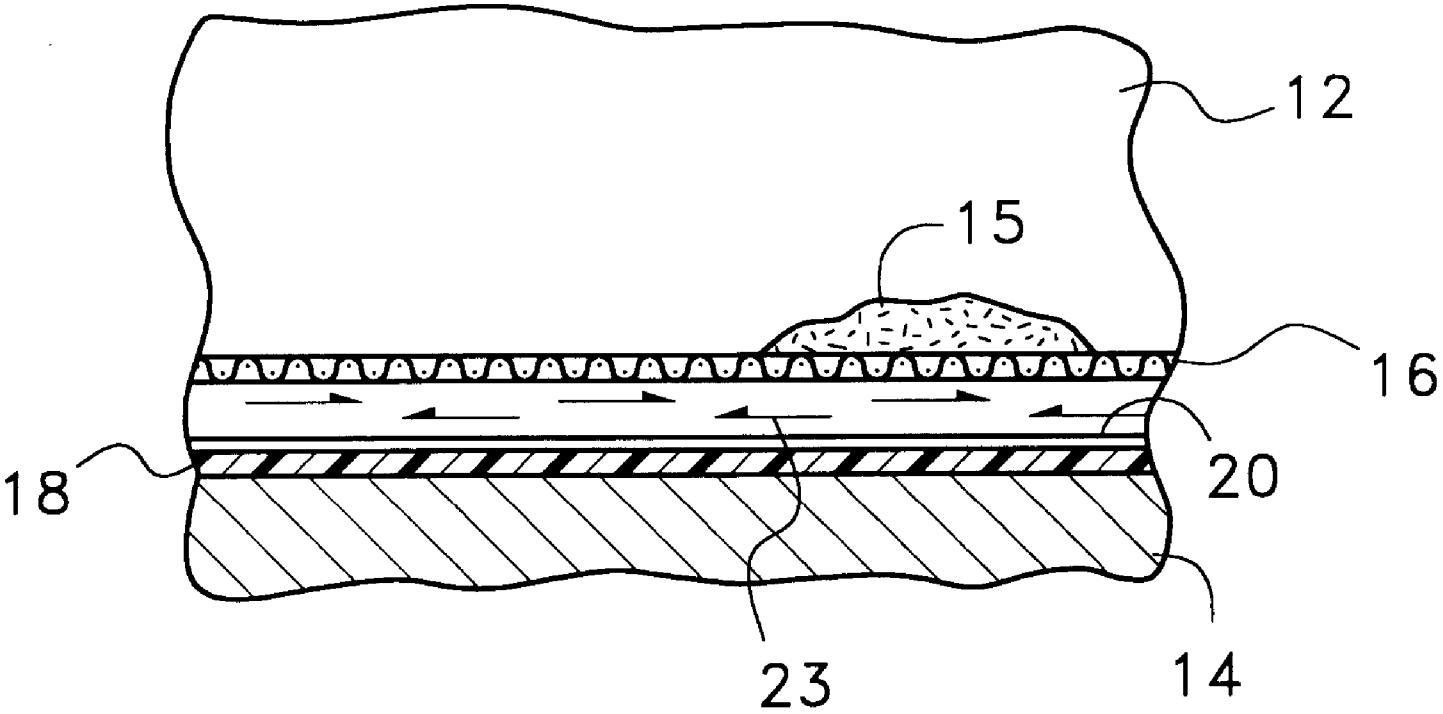
FIG. 2 is a cross-sectional view of a segment of the exemplary embodiment shown in FIG. 1.

Referring to FIG. 2, it can be seen that the knit material of the sock 16 cushions the skin on the foot 12. Furthermore, as the foot 12 moves within the confines of the shoe 14, the interface in between the skin of the foot 12 and the interior of the sock 16 remains relatively static. As such, no material is moved across the area of a contact sore 15 that can aggravate that injury. Similarly, the interface in between the shoe insert 18 and the shoe 14 remains relatively static as the foot 12 moves within the confines of the shoe 14. All movement within the shoe 14 is generated along the interface in between the exterior of the sock 16 and the top surface 20 of the shoe insert 18, as is indicated by arrows 23. This is because the exterior of the sock 16 and the top surface 20 of the shoe insert 18 are both manufactured with materials that have a low coefficient of friction. The interface in between the exterior of the sock 16 and the top surface 20 of the shoe insert 18 therefore moves at a lower threshold of force than any of the other interface points.

The low coefficient of friction in between the exterior of the sock 16 and the top surface 20 of the shoe insert 18 reduces the frictional forces experienced by the foot 12. Furthermore, the presence of the sock 16 around the foot 12 cushions the foot and distributes many of the forces that are experienced by the foot so that those forces are not experienced at a concentrated point on the foot 12.

Figure 3:
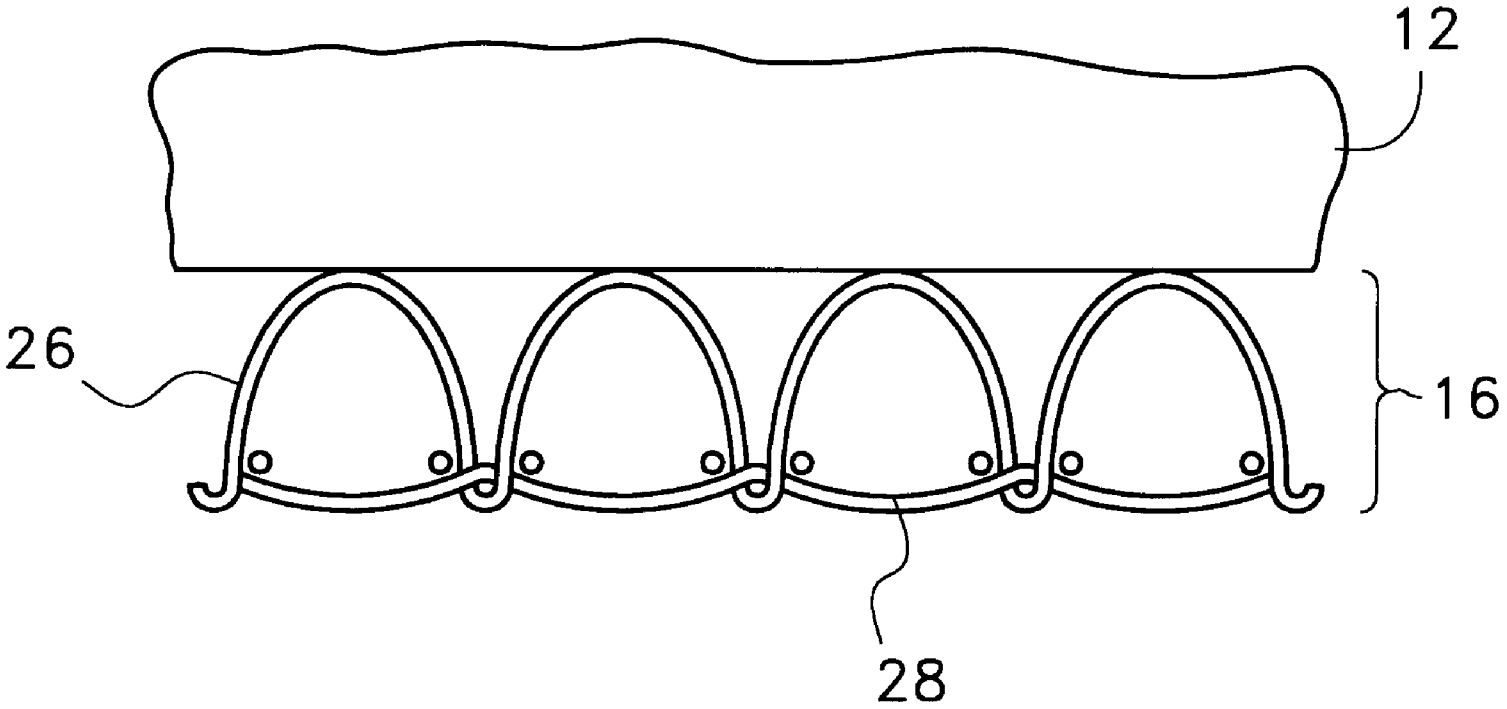
FIG. 3 is a cross-sectional view of an exemplary knit pattern used in creating the sock shown in FIG. 1.

Referring to FIG. 3, it can be seen that the knit pattern of the sock 16 is created so that a large area of knitted loops 26 are created on the interior of the sock 16. The large loops 26 in the knit pattern help to cushion the skin of the foot 12 and distribute forces across the skin. The individual large loops 26 conform to the contours of the foot 12 and inhibit the movement of any material across the skin or any contact sore present on the skin. As has been previously mentioned, the thread used to create the loops 26 on the interior of the sock 16 is made from conventional materials such as cotton, acrylic, wool, or polyester. Conventional materials are therefore the predominant material on the interior of the sock 16. The knit pattern of the sock 16 also contains a cross thread 28 that is the predominant thread on the exterior of the sock 16. It is this cross thread 28 that is made of polytetrafluoroethylene or a similar fluoropolymer. As such, a fluoropolymer is the predominant material on the exterior of the sock 16.

It will be understood that the use of the shoe insert 18 (FIG. 1) is optional. The purpose of the shoe insert is to ensure that the interface involving the exterior of the sock 16 is the interface containing the lowest coefficient of friction. However, in many types of shoes, the interior sole of the shoe is smooth. As a result, even if the shoe insert were not used, the interface in between the exterior of the sock 16 and the interior of the shoe would still have a coefficient of friction that is significantly less that the interface between the foot 12 and the interior of the sock 16. As a result, the use of a shoe insert helps in the functioning of the present invention system, however, the shoe insert is not necessary.

Figure 4:
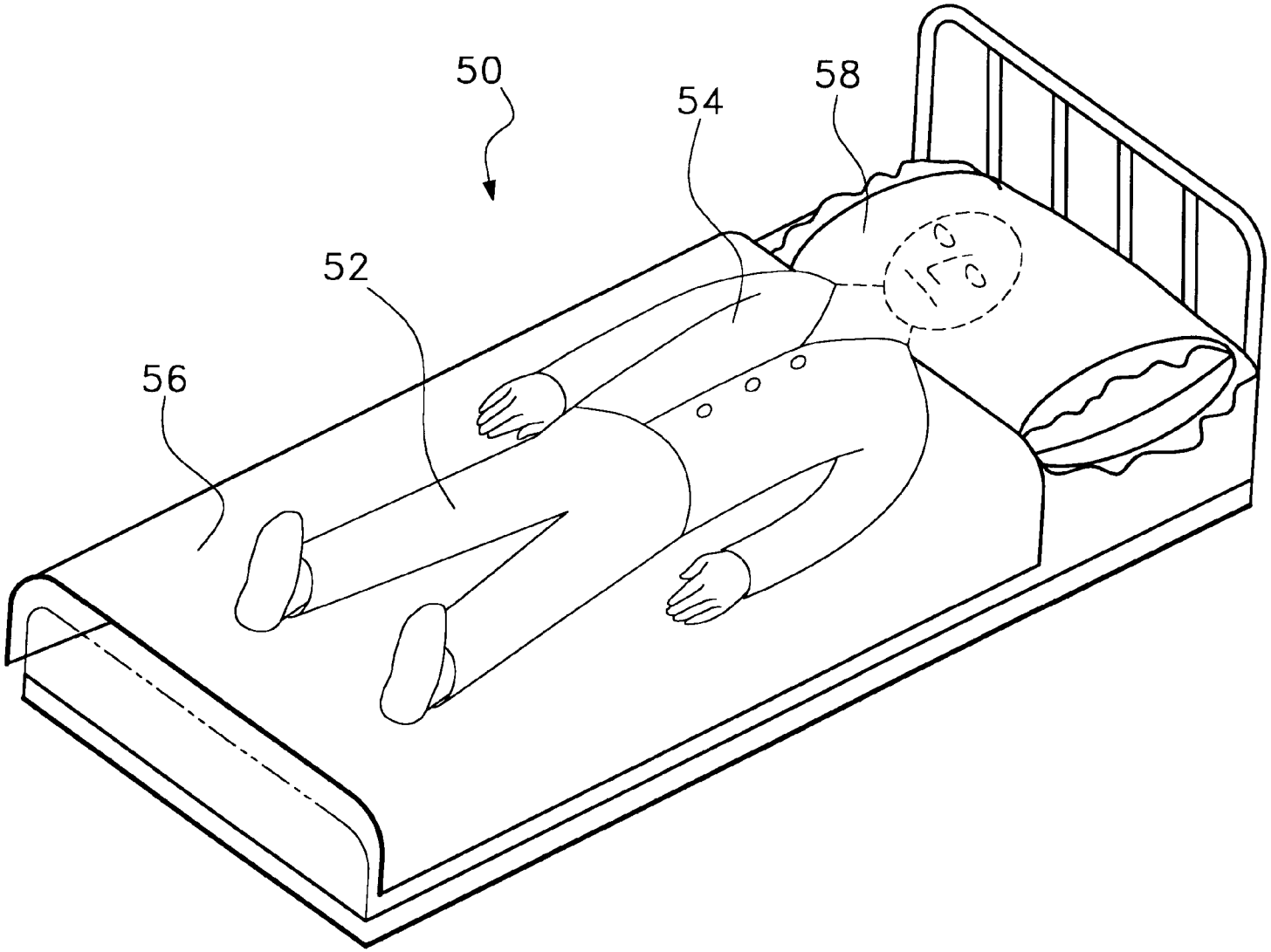
FIG. 4 is a perspective view of an alternate embodiment of the present invention.

Referring to FIG. 4, an alternate embodiment of the present invention system 50 is illustrated. In this embodiment, a pair of pants 52 and a shirt 54 are fabricated from the same knit or woven material as was the sock of the previous embodiment. As a result, the interior of the shirt 54 and pants 52 are predominantly made of conventional materials such as cotton, acrylic, wool and polyester. Adversely, the exterior of the pants 52 and shirt 54 predominantly contain a fluoropolymer. The interior of the pants 52 and shirt 54 therefore have a much higher coefficient of friction than does the exterior of the same pants 52 and shirt 54. Furthermore, the bed cover 56 and pillow case 58 on the bed are also made from a material that has a low coefficient of friction. If desirable, the bed covers can be made of the same material as are the pants 52 and the shirt 54. The bed covers are placed on the bed so that the side of the covers with the low coefficient of friction are facing the person lying in the bed and contacting the exterior of the pants 52 and shirt 54 worn by that person. Since the low friction exterior of the pants 52 and shirt 54 are contacting the low friction material of the bed covers, most movement will occur at the interface between where the bed covers contact the shirts 54 and pants 52. The degree of movement in between a person's skin and the shirt 54 and pants 52 is therefore lessened. A person would therefore be much less likely to develop bed sores or aggravate bed sores that already exist on that person's body.

From the two embodiments of the present invention illustrated, it will be understood that present invention can involve any garment that separates skin from an object. Furthermore, the present invention system may also include a cover for that object so that the interface in between the garment and the object being contacted is significantly less than the coefficient of friction in between the skin and the garment. In this manner, most movement will occur at the garment/object interface rather than at the skin/garment interface. By limiting movement along the skin/garment interface, chaffing, blistering and the development of sores are reduced.

It will be understood that the embodiments of the present invention described and illustrated herein are merely exemplary and a person skilled in the art can make many variations to the embodiment shown without departing from the scope of the present invention. For example, although a knit pattern was illustrated, the present invention can be practiced with woven patterns as well. It should also be understood that the various elements from the different embodiments shown can be mixed together to create alternate embodiments that are not specifically described. All such variations, modifications and alternate embodiments are intended to be included within the scope of the present invention as defined by the appended claims.

What is claimed is:

1. A garment to be worn on the body having an interior surface and an exterior surface, said garment being fabricated from a material containing a plurality of different threads in a predetermined knit pattern, said plurality of different threads having at least one first thread made from a conventional garment material and at least one second thread made from a fluoropolymer material, wherein said predetermined knit pattern makes said at least one first thread predominant on said interior surface of said garment and said at least one second thread predominant on said exterior surface of said garment.

2. The garment according to claim 1, wherein said fluoropolymer material includes polytetrafluoroethylene.

3. The garment according to claim 1, wherein said conventional material is selected from a group consisting of cotton, acrylic, wool and polyester.

4. The garment according to claim 1, wherein said garment is configured as a sock.

5. A system for reducing contact sores on areas of the body that contact an external object, said system comprising:

a garment having an interior surface and an exterior surface, said garment being fabricated from a plurality of threads in a knit pattern that produces at least one predominant thread on said interior surface of said garment and at least one predominant thread on said exterior of said garment, wherein said at least one predominant thread on said exterior surface of said garment has a coefficient of friction lower than said at least one predominant thread on said interior surface; and a cover for covering at least one surface of said external object, wherein said cover has a coefficient of friction lower than said object.

6. The system according to claim 5, wherein at least one predominant thread on said exterior surface of said garment is at least partially comprised of a fluoropolymer.

7. The system according to claim 5, wherein said cover is at least partially comprised of a fluoropolymer.

8. The system according to claim 5, wherein said garment is a sock and said object is a shoe.

9. The system according to claim 8, wherein said cover is configured as a shoe insert.

10. The system according to claim 5, wherein said fluoropolymer material includes polytetrafluoroethylene.

11. The system according to claim 5, wherein said conventional material is selected from a group consisting of cotton, acrylic, wool and polyester.

12. The system according to claim 5, wherein said garment is selected from a group consisting of socks, pants and shirts.

13. A method of reducing the development of contact sores on the skin at points where the body contacts an external object, said method comprising the steps of:

providing a garment having an internal surface and an external surface, said garment being fabricated from a plurality of threads in a knit pattern that produces at least one predominant thread on said interior surface of said garment and at least one predominant thread on said exterior of said garment, wherein said at least one predominant thread on said external surface has a lower coefficient of friction than does said at least one predominant thread on said internal surface;

providing a cover for at least one surface of said external object, wherein said cover has a coefficient of friction lower than that of said at least one surface;

placing said cover over said at least one surface of said external object;

placing said garment over the skin, wherein said external surface of said garment contacts said cover and creates a low friction interface.

14. The method according to claim 13, wherein said low friction interface has a lower coefficient of friction than exist in between the skin and said interior surface of said garment.

15. The method according to claim 13, wherein at least one predominant thread on said exterior surface of said garment is at least partially comprised of a fluoropolymer.

16. The method according to claim 13, wherein said cover is at least partially comprised of a fluoropolymer.

17. The method according to claim 13, wherein said garment is a sock, said object is a shoe and said cover is a shoe liner.

18. The method according to claim 13, wherein said fluoropolymer material includes polytetrafluoroethylene.

* * * * *